US011866215B2

(12) United States Patent
Trebbi et al.

(10) Patent No.: US 11,866,215 B2
(45) Date of Patent: Jan. 9, 2024

(54) OPENING ASSEMBLY FOR A PACKAGE

(71) Applicant: I.M.A. INDUSTRIA MACCHINE AUTOMATICHE S.P.A., Ozzano dell'Emilia (IT)

(72) Inventors: Claudio Trebbi, Medicina (IT); Gabriele Gabusi, Castenaso (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 60 days.

(21) Appl. No.: 16/321,433

(22) PCT Filed: Jul. 24, 2017

(86) PCT No.: PCT/EP2017/068670
§ 371 (c)(1),
(2) Date: Jan. 28, 2019

(87) PCT Pub. No.: WO2018/019782
PCT Pub. Date: Feb. 1, 2018

(65) Prior Publication Data

US 2019/0177026 A1 Jun. 13, 2019

(30) Foreign Application Priority Data

Jul. 26, 2016 (IT) ..... 102016000078059

(51) Int. Cl.
*B65B 69/00* (2006.01)
*B65B 43/30* (2006.01)

(52) U.S. Cl.
CPC ..... *B65B 69/0025* (2013.01); *B65B 43/30* (2013.01); *B65B 69/00* (2013.01)

(58) Field of Classification Search
CPC ..... B65B 69/00; B65B 69/0025; B65B 43/30; B65B 43/40; B65B 43/26; B65B 43/006; B67B 7/40
See application file for complete search history.

(56) References Cited

U.S. PATENT DOCUMENTS 2,694,324 A * 11/1954 Goldsmith ..... B67B 7/20 81/3.27
6,503,130 B2 * 1/2003 Lim ..... B24B 37/34 156/716

(Continued)

FOREIGN PATENT DOCUMENTS

DE 4419475 A1 12/1995
WO WO-2013/166379 A1 11/2013

OTHER PUBLICATIONS

International Search Report and Written Opinion for PCT/EP2017/068670, dated Sep. 20, 2017.

*Primary Examiner* — Thomas M Wittenschlaeger
(74) *Attorney, Agent, or Firm* — MARSHALL, GERSTEIN & BORUN LLP

(57) ABSTRACT

An opening assembly for a package, particularly for containers including vials, bottles, syringes, and carpules which can be installed in a container handling and filling system. The package includes a tub covered by a covering film, the tub containing a nest bearing the containers in an orderly manner. The opening assembly includes at least one clamp located upstream of an opening placed on a separation wall between a first and second sterile environment. While the package passes through the opening, the clamp clamps a portion of an edge of the covering film, consequently removing the covering film from the tub.

15 Claims, 7 Drawing Sheets

(56) References Cited

U.S. PATENT DOCUMENTS

| | | | | |
|---|---|---|---|---|
| 7,644,747 | B2 * | 1/2010 | Ohkawara | H01L 21/67132 156/764 |
| 8,813,464 | B2 * | 8/2014 | Leidig | B65B 69/0008 53/457 |
| 9,102,430 | B2 * | 8/2015 | Monti | B67B 7/40 |
| 9,902,584 | B2 * | 2/2018 | Kramer | B65H 18/026 |
| 10,081,527 | B2 * | 9/2018 | Gold | B67B 7/14 |
| 10,209,559 | B2 * | 2/2019 | Sun | G02F 1/133308 |
| 10,391,752 | B2 * | 8/2019 | Peng | H01L 51/56 |
| 2008/0185100 | A1 * | 8/2008 | Jang | G02F 1/1303 156/714 |
| 2008/0236743 | A1 * | 10/2008 | Kye | B32B 43/006 156/714 |
| 2008/0245483 | A1 * | 10/2008 | Toyoshima | B32B 43/006 156/763 |
| 2009/0208316 | A1 * | 8/2009 | Mayer | B65B 69/0033 414/729 |
| 2014/0174041 | A1 * | 6/2014 | Monti | B65B 69/0033 53/492 |
| 2015/0261206 | A1 * | 9/2015 | Shiino | G05B 19/409 700/257 |
| 2018/0339796 | A1 * | 11/2018 | Bai | B65B 65/003 |
| 2019/0177013 | A1 * | 6/2019 | Bertolin | B65B 43/42 |

* cited by examiner

OPENING ASSEMBLY FOR A PACKAGE

BACKGROUND OF THE INVENTION

Field of the Invention

This invention concerns an opening assembly for a package, particularly for containers, preferably vials, bottles, syringes, carpules and the like, which can be installed in a container handling and filling system.

Related Technology

It is known that, in the pharmaceutical industry, products and substances in liquid and/or powder form can be appropriately packaged in special containers, often designed to contain a single dose, in order to facilitate their administration to patients.

These containers may be bottles, vials, cartridges (such as, for example carpules, used in syringes, intended to administer local anaesthetics), syringes (such as ready-to-use syringes used for many miscellaneous applications) and similar devices.

The known procedures for filling and packaging containers such as bottles, cartridges, syringes and similar devices require the provision of tubs containing suitable nests, within which the individual containers are neatly arranged.

The tubs, nests and containers to be filled are manufactured by their suppliers, which generally differ from those taking care of the filling procedure.

Therefore, in order to protect the contents of the tub from any risk of contamination by the outside environment, before sending the package to the filling and packaging system, the tub is sealed with a covering film and inserted into a bag.

Once the tub has been extracted from the bag, it is necessary to remove the covering film.

This procedure is normally carried out in a special environment with a minimal risk of contamination (for example, contamination class A).

It should also be noted that such procedure is very delicate and may expose the containers to contamination due to particles that could remain in the air and enter the tub and, therefore, the containers, when the covering film is removed.

SUMMARY OF THE INVENTION

The main aim of this invention is to resolve the above problems, by providing an opening assembly for a package that eliminates the risk of contamination of the contents of the package during the process of removing the covering film from such package.

Within the scope of this aim, one purpose of this invention is to propose a relatively easy-to-use, practical, safe and cost-effective opening assembly for a package.

This aim and these purposes are achieved by an opening assembly for a package according to claim 1.

BRIEF DESCRIPTION OF THE DRAWINGS

Additional features and advantages of this invention are further detailed in the description of a preferred, but not exclusive, form of execution, of the opening assembly for a package according to the invention, illustrated by way of a non-limiting example, in the accompanying drawings, in which.

DETAILED DESCRIPTION

Figure 1:
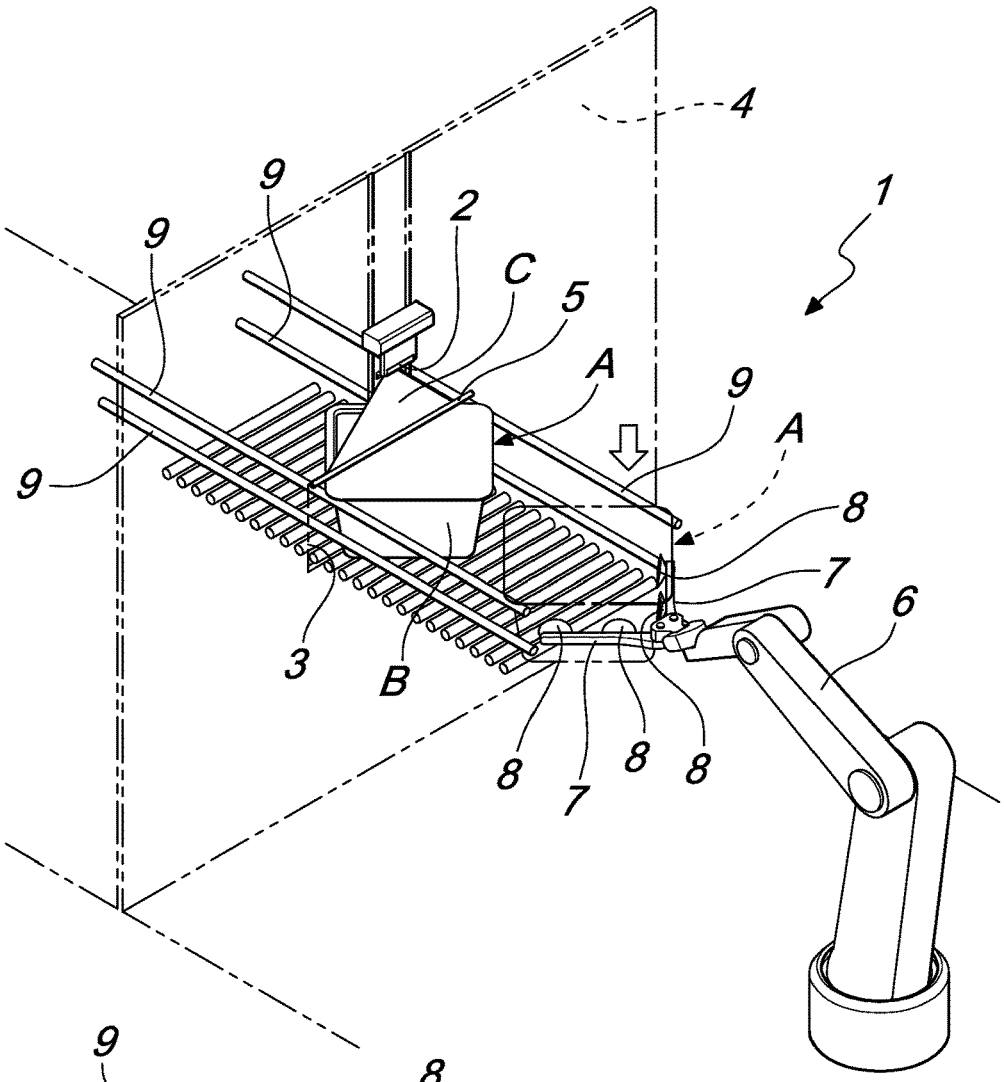
FIG. 1 shows an axonometric view of the opening assembly, according to this invention, during an intermediate package opening phase.
Figure 2:
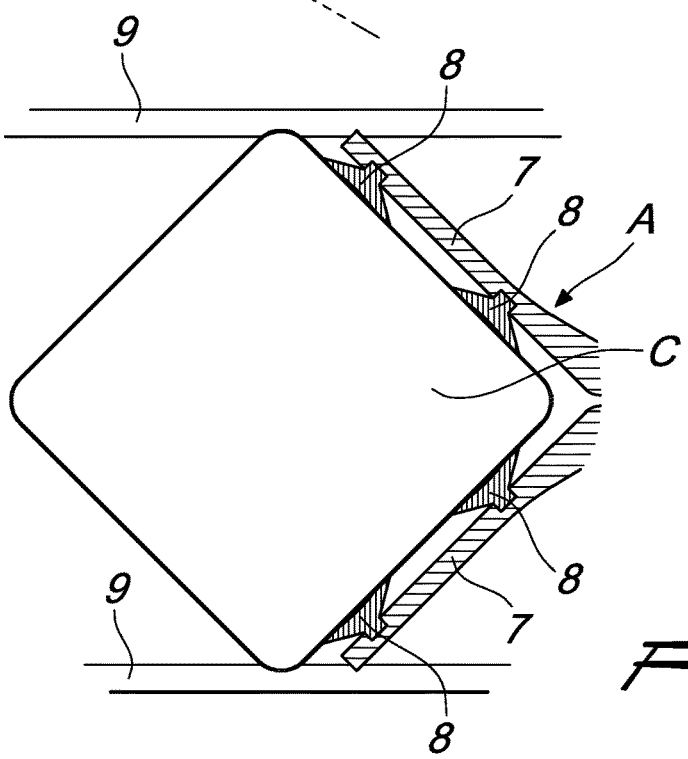
FIG. 2 shows an aerial view of the assembly as shown in FIG. 1, according to the invention.
Figure 3:
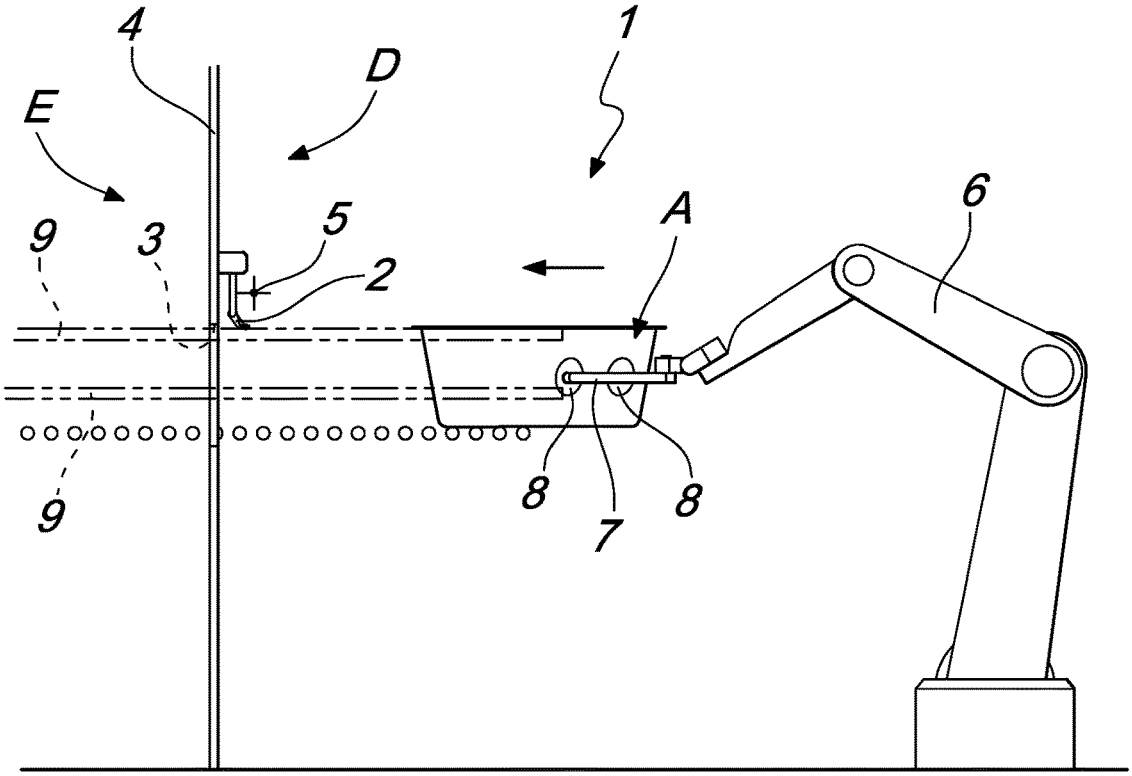
FIG. 3 shows a cross-sectional view of the assembly as shown in FIG. 1, according to the invention, in a first clamping phase of a package by at least one clamp.
Figure 4:
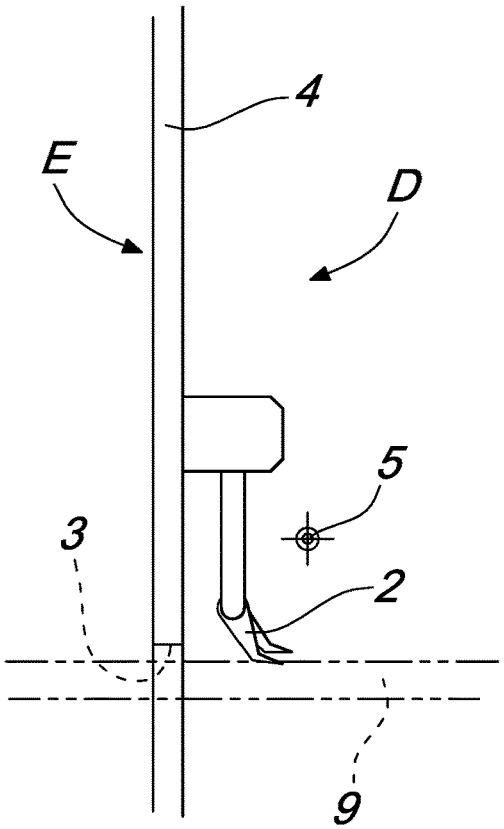
FIG. 4 shows an enlarged view of a portion of FIG. 3.
Figure 5:
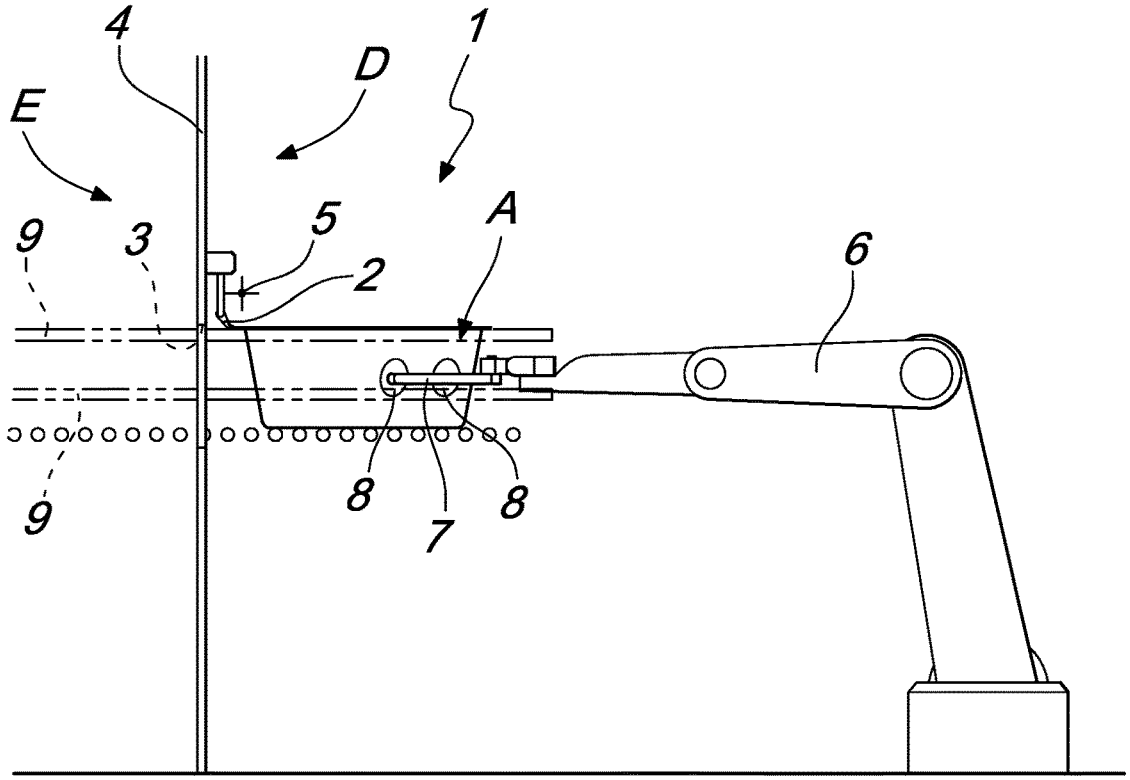
FIG. 5 shows a cross-sectional view of the assembly as shown in FIG. 1, according to the invention, in a package alignment phase to at least one clamp.
Figure 6:
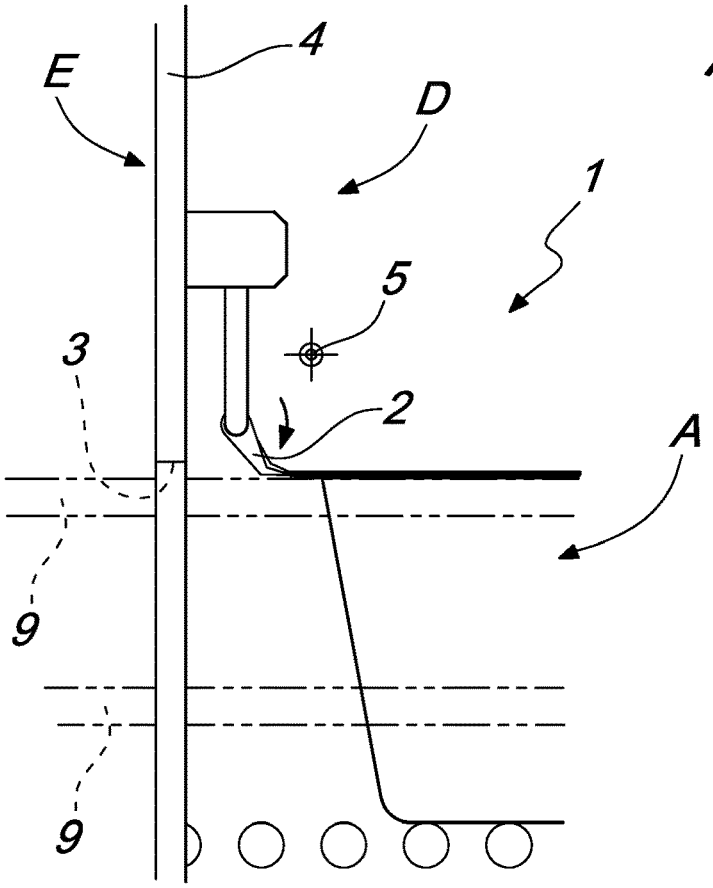
FIG. 6 shows an enlarged view of a portion of FIG. 5.
Figure 7:
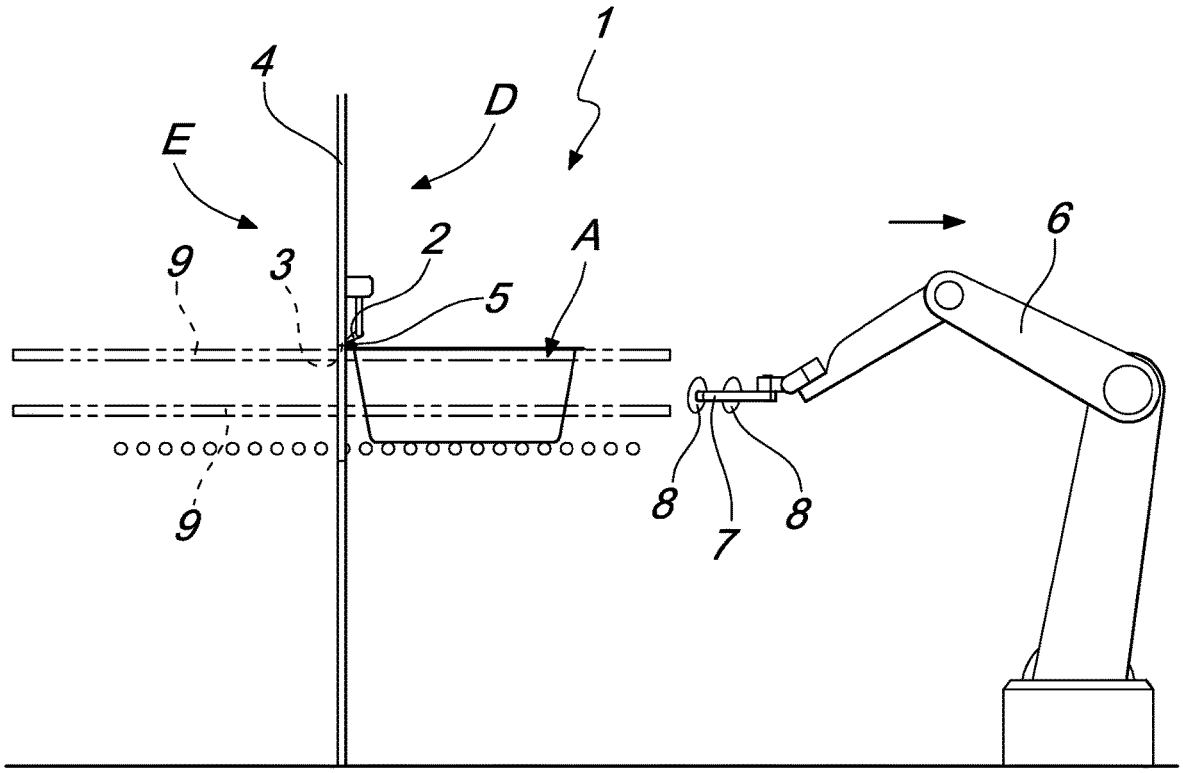
FIG. 7 shows a cross-sectional view of the assembly as shown in FIG. 1, according to the invention, in a clamping phase with at least one clamp on a portion of a covering film.
Figure 8:
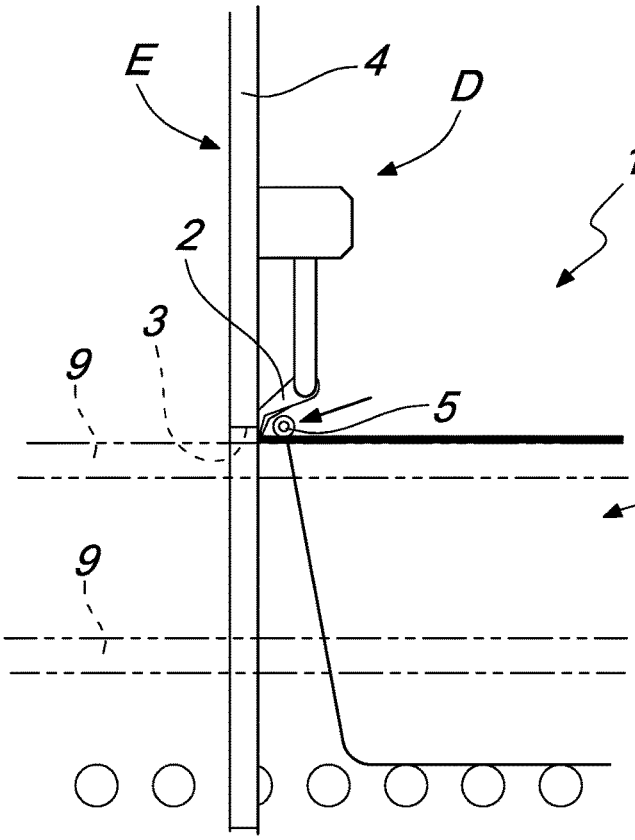
FIG. 8 shows an enlarged view of a portion of FIG. 7.
Figure 9:
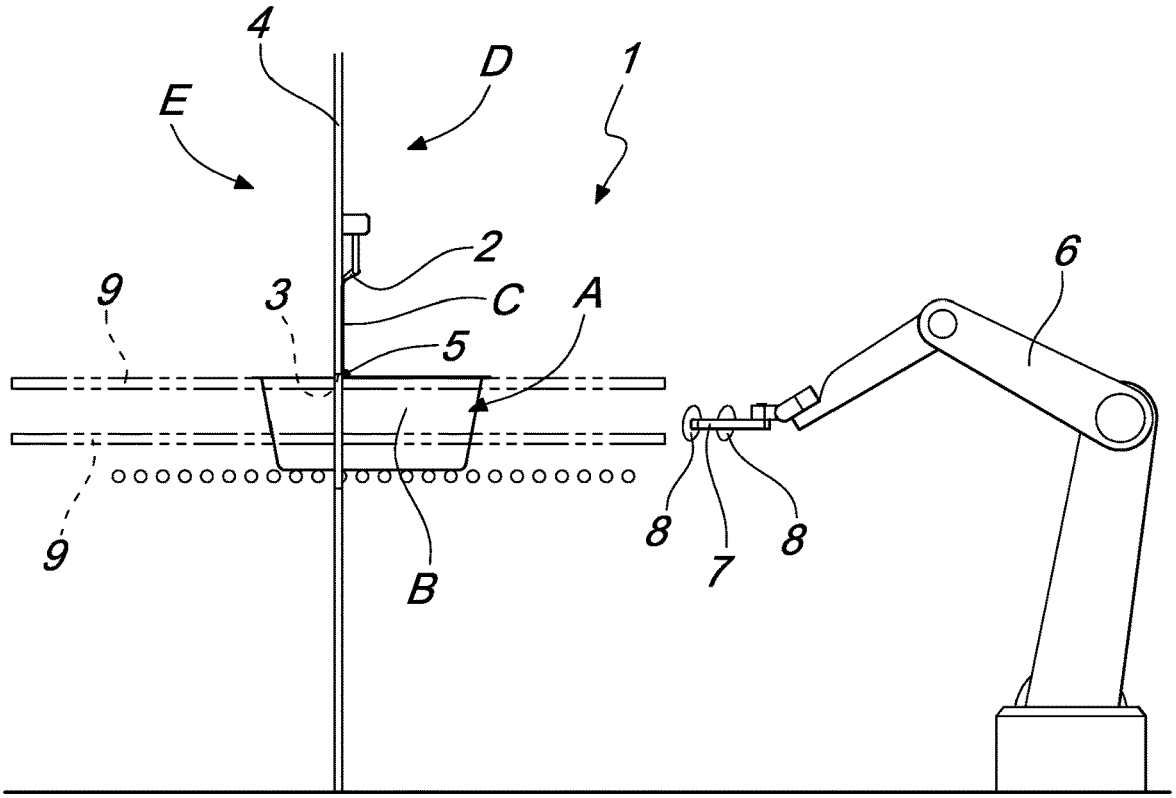
FIG. 9 shows a cross-sectional view of the assembly as shown in FIG. 1, in an intermediate film-removal phase.
Figure 10:
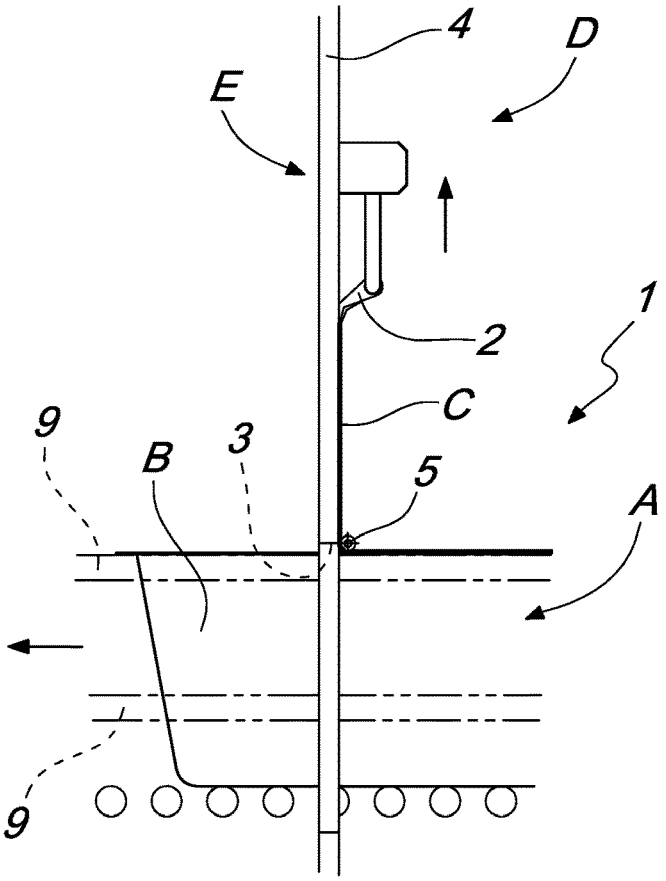
FIG. 10 shows an enlarged view of a portion of FIG. 9.
Figure 11:
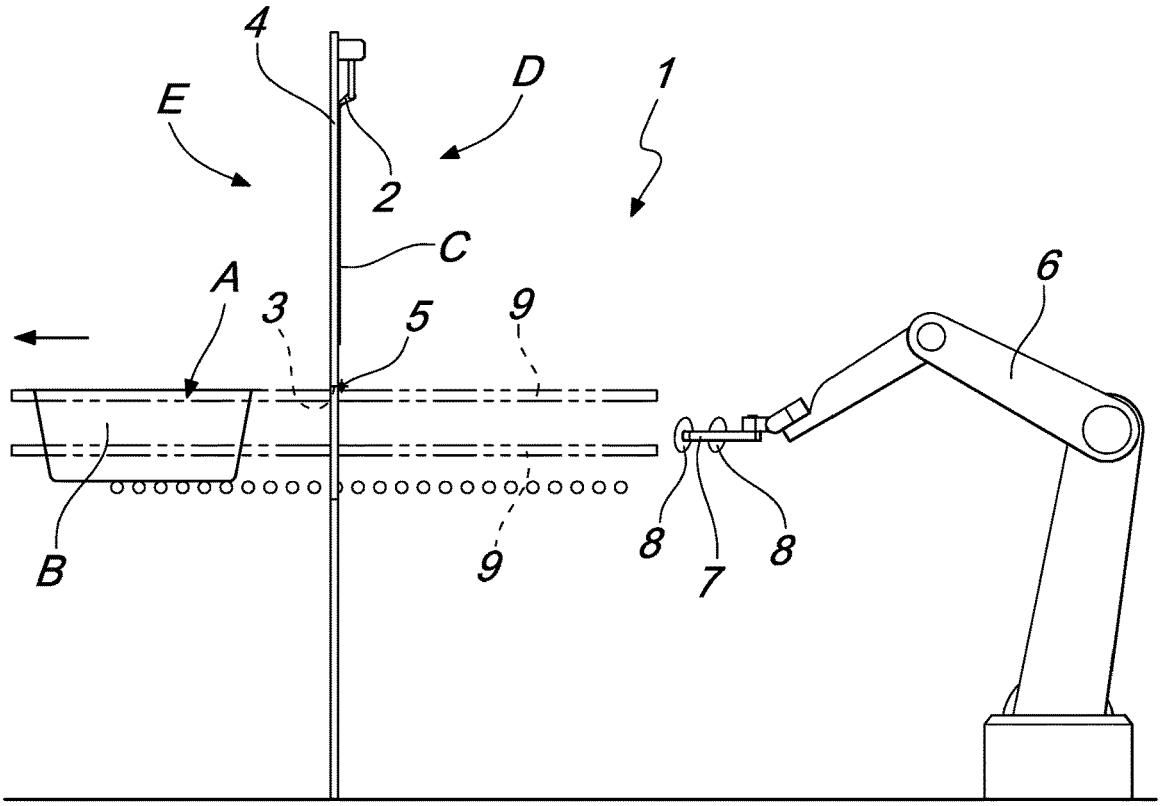
FIG. 11 shows a cross-sectional view of the assembly as shown in FIG. 1, in a final package-opening phase, when the film is completely removed from the tub.
Figure 12:
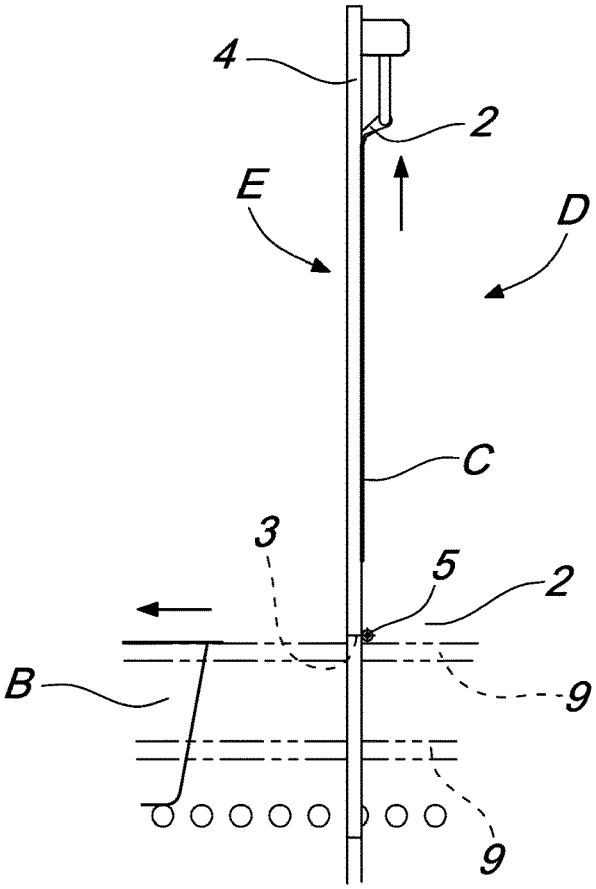
FIG. 12 shows an enlarged view of a portion of FIG. 11.

With specific reference to these figures, 1 globally indicates an opening assembly for a package A, particularly for containers such as: vials, bottles, syringes, carpules and the like.

This assembly 1 can be installed in a container handling and filling system.

The package A comprises a tub B, with a covering film C, containing a nest bearing the containers in an orderly manner.

According to the invention, the opening assembly 1 comprises at least one clamp 2 located upstream of an opening 3 placed on a separation wall 4 between a first sterile environment D and second sterile environment E, located upstream and downstream said opening 3 respectively.

Where upstream and downstream refer to the moving direction of the tub B.

It should also be noted that a "clamp" 2 refers to any clamping device.

Whilst the package A passes through the opening 3, passing from the first sterile environment D to second sterile environment E, the clamp 2 clamps an edge of the covering film C, consequently removing the covering film.

Removing the covering film C, by clamping it and raising it by means of the clamp 2, within the first environment D, before the package A completely passes through the opening 3, prevents particles that could be released during this removal procedure from entering the second environment E, where the package A have no covering film C and is, therefore, exposed to the risk of contamination.

According to a useful feature, the first environment D can have a lower contamination class that the second environment E.

It should be noted that each contamination class corresponds to a maximum allowed number of particles present in the environment.

It is essential to minimise the entry, generation and retention of airborne particles within the environments, in order to enable contamination-susceptible activities to be carried out.

According to an undeniably easy-to-use and practical solution, the clamp 2 can be moved in a direction substantially perpendicular to the direction of movement of the package A, by the action of a respective actuator.

In the figures, the package moves horizontally and the clamp vertically.

Specifically, the clamp 2 can be moved between a first clamping configuration to the package A, to a second raised configuration.

It should be noted that, in the raised configuration, the clamp 2 is raised from the package A by a distance from the bottom of the opening which is equal to at least the length of the covering film C, when the covering film C has been removed from the package A and the package A fully entered in the second environment E. By removing the covering film C by clamping it and raising it using the clamp 2, the package A is conveyed from the first environment D to the second environment E.

It is also possible that the assembly 1 may comprise an abutment bar 5 for the covering film C, this bar 5 is arranged so as to face and be closed to the separation wall 4, at the upstream of the opening 3, in the vicinity of a top portion (the covering film) of the package A.

The presence of the bar 5 therefore prevents the raising of the package A during the removal of the covering film C by the clamp 2.

The assembly 1 may also comprise a handling device 6 provided with coupling elements 7 for the package A.

This handling device 6 is designed to move the package A through the opening 3 from the first environment D to the second environment E.

Figure 13:
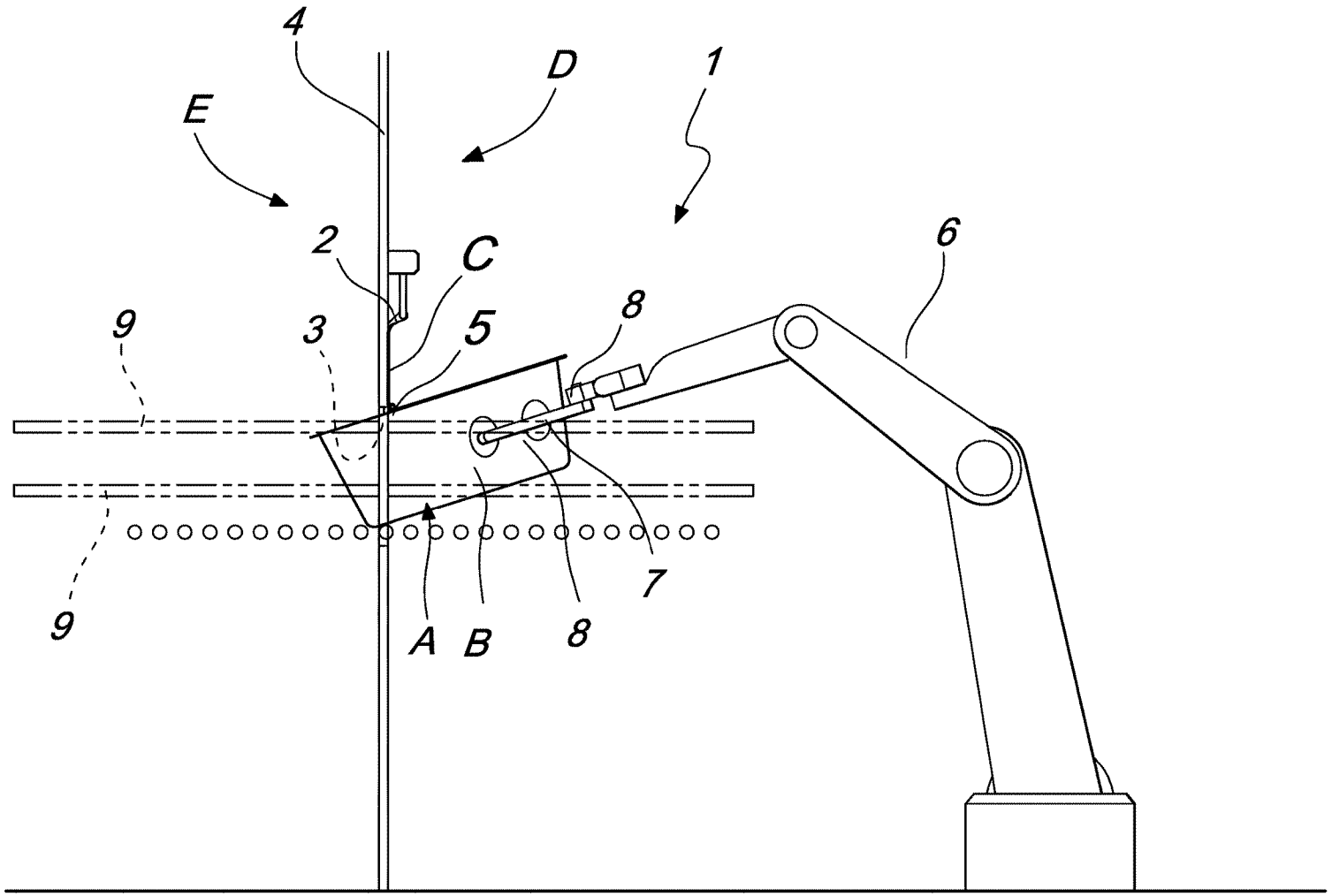
FIG. 13 shows a cross-sectional view of a different embodiment of the assembly of FIG. 1, in an intermediate film-removal phase.

According to a different embodiments, showed in FIG. 13, the clamp 2 can be fixed at a distance form a bottom side of the opening 3 and the handling device 6, as a consequence of the clamping of the clamp 2 on the covering film C, draws a sloping downwards trajectory towards the opening 3, in order to distance the package A from the clamp 2 and therefore remove the covering film C.

It is also possible that the handling device 6 may have securing elements 8 to secure the package A, in order to prevent it from rising during the removal of the covering film C.

It should also be noted that the handling device 6 may be a high-precision anthropomorphic robot.

According to a preferred embodiment, the coupling elements 7 are movable within the space, with at least 6 degrees of freedom of movement, according to the three cartesian axes and also have three degrees of freedom of rotation.

In order to ensure that the handling device 6 performs the appropriate alignments of the package A in order to enable the clamp 2 to remove the covering film C, the assembly 1, according to the invention, comprises a programmable control and management unit for the controlled movement of at least one component, chosen from the handling device 6 and the clamp 2.

The assembly 1 may comprise at least two opposite containment shoulders 9 arranged to guide the package A whilst the package A moves through the opening 3.

The pressure within the second environment E may be higher than the pressure within the first environment D, such different pressures causing a constant flow of gas through the opening 3 from the second environment E to the first environment D, such flow investing the package A whilst it passes through the opening (3).

By removing the covering film C, by clamping it and raising using the clamp 2, within the first environment D, before the package A completely passes through the opening 3, prevents particles that could be released during this removal procedure from entering the package A.

In fact, these particles, possible produced during this removal procedure, are driven by the flow that invest the package A towards the first environment D and therefore towards a portion of the package A which is still covered by the covering film C.

If the package A comprises a protection sheet between the covering film C and the contents, the protection sheet can be removed in the second environment E, as its removal does not cause any particle formation.

Advantageously, this invention resolves the above problems, by proposing an opening assembly 1 for a package A that eliminates the risk of contamination of the contents of the package A during the removal of the covering film C from the package A.

The invention, thus conceived, is subject to numerous changes and variations, all falling within the scope of protection of the invention; also, all details can be replaced by other technically equivalent elements.

In the illustrated examples, individual features, shown in relation to specific examples, can, in reality, be interchanged with other different features, existing in other examples of implementation.

In practice, the materials used, as well as the dimensions, can be of any kind, according to the needs and status of the technique.

The invention claimed is:

1. An opening assembly for a package holding containers and for use with an apparatus for the handling and filling of said containers, said package comprising a tub provided with a covering film, the tub containing an internal nest of the containers, the opening assembly comprising: a programmable control and management unit and at least one clamp arranged upstream of an opening that is formed on a separation wall separating a first sterile environment from a second sterile environment, the first and second sterile environments being disposed upstream and downstream, respectively, relative to said opening, wherein said clamp is positioned adjacent to the opening, and wherein the programmable control and management unit controls and coordinates the movement of the package and the clamp to thereby move the package from the first environment to the second environment while the clamp clamps an edge of the covering film in the first environment to remove the covering film from the tub while the package is moved through the opening moving from the first environment to the second environment.

2. The opening assembly according to claim 1, wherein said clamp is configured to translate, along a direction substantially perpendicular to a direction of advancement of the package, between a first configuration in which the clamp is in a lowered position adjacent to the tub and a second configuration in which the clamp is in a raised condition at a distance equal to at least the length of the covering film, once the covering film has been completely removed from the package and the package is placed completely in the second environment.

3. The opening assembly according to claim 1, further comprising a handling device positioned in the first environment and configured to move the package through the opening while said clamp clamps a portion of the edge of the covering film in the first environment.

4. The opening assembly according to claim 3, wherein the clamp is arranged on the wall and adjacent to the opening, the clamp being configured to clamp the covering film of the tub while the handling device pushes the tub through the opening.

5. The opening assembly according to claim 3, wherein the handling device is configured to follow a sloping downwards trajectory towards the opening while the clamp clamps the covering film.

6. The opening assembly according to claim 1, wherein the apparatus for the handling and filling of said containers has securing elements configured to secure the package in order to prevent it from lifting while the package moves from the first environment to the second environment for removing of the covering film.

7. The opening assembly according to claim 1, wherein the apparatus for the handling and filling of said containers is a robot.

8. The opening assembly according to claim 1, comprising a programmable control and management unit for controlling and coordinating the movement of the package and the clamp so that the clamp removes the covering film from the tub while the package is moved through the opening from the first environment to the second environment.

9. The opening assembly according to claim 1, comprising a pair of spaced apart containment shoulders arranged to guide the package while the package moves through the opening.

10. The opening assembly according to claim 1, wherein the pressure within the second environment is higher than the pressure within the first environment, such different pressures causing a constant flow of gas through the opening from the second environment to the first environment, such flow entering the package while the covering film is removed from the tub while passing through the opening.

11. The opening assembly according to claim 1, wherein the clamp is configured to clamp the covering film above the opening.

12. An opening assembly for a package holding containers and for use with an apparatus for the handling and filling of said containers, said package comprising a tub provided with a covering film, the tub containing an internal nest of the containers, the opening assembly comprising: at least one clamp arranged upstream of an opening that is formed on a separation wall separating a first sterile environment from a second sterile environment, the first and second sterile environments being disposed upstream and downstream, respectively, relative to said opening, said clamp being adjacent the opening and positioned to clamp a portion of an edge of the covering film when the package passes through said opening, thereby removing the covering film from the tub as the package proceed through the opening; and further comprising an abutment bar for said covering film, which is arranged so as to face and be close to said separation wall, in the vicinity of a top portion of the package, said abutment bar blocking lifting of the package during the removal of the covering film from the tub.

13. An opening assembly for opening a package having a covering film and which houses containers, the opening assembly comprising:

a separation wall separating a first environment from a second environment, the separation wall being provided with an opening that puts the first environment in communication with the second environment;

a clamp arranged in the first environment, the clamp being arranged on the separation wall and positioned adjacent to the opening, the clamp further arranged to clamp a portion of the covering film while the package is in the first environment; and wherein the covering film is removed from the package within the first environment by the clamp while the package passes through the opening moving from the first environment to the second environment.

14. The opening assembly according to claim 13, and further comprising a handling device which moves the package through the opening from the first environment to the second environment while the clamp is removing the covering film.

15. An opening assembly for a package holding containers and for use with an apparatus for the handling and filling of said containers, said package comprising a tub provided with a covering film, the tub containing an internal nest of the containers, the opening assembly comprising: at least one clamp arranged upstream of an opening that is formed on a separation wall separating a first sterile environment from a second sterile environment, the first and second sterile environments being disposed upstream and downstream, respectively, relative to said opening, wherein said clamp is positioned adjacent to the opening, and wherein the package is made to move from the first environment to the second environment while the clamp clamps an edge of the covering film in the first environment to remove the covering film from the tub while the package passes through the opening moving from the first environment to the second environment; and further comprising an abutment bar arranged so as to face and be adjacent to the separation wall in the vicinity of the opening, the abutment bar being configured to block lifting of the package during removal of the covering film from the tub.

* * * * *